US010604930B2

(12) United States Patent
Downey

(10) Patent No.: US 10,604,930 B2
(45) Date of Patent: Mar. 31, 2020

(54) FRICTION ADJUSTMENT MEMBER FOR ARCHITECTURAL COVERING

(71) Applicant: Hunter Douglas Inc., Pearl River, NY (US)

(72) Inventor: Joseph Mark Downey, Gilbert, AZ (US)

(73) Assignee: Hunter Douglas Inc., Pearl River, NY (US)

( * ) Notice: Subject to any disclaimer, the term of this patent is extended or adjusted under 35 U.S.C. 154(b) by 223 days.

(21) Appl. No.: 15/433,944

(22) Filed: Feb. 15, 2017

(65) Prior Publication Data

US 2018/0230728 A1 Aug. 16, 2018

(51) Int. Cl.

| | |
|---|---|
| ***E04B 2/82*** | (2006.01) |
| ***E05D 15/06*** | (2006.01) |
| ***E05D 15/08*** | (2006.01) |

(52) U.S. Cl.

CPC ..... *E04B 2/827* (2013.01); *E05D 15/0613* (2013.01); *E05D 15/0621* (2013.01); *E05D 15/08* (2013.01)

(58) Field of Classification Search

CPC ... E05D 15/0621; E05D 15/264; E05D 15/08; E05D 15/0626; E05D 15/063; E05D 15/0634; E05D 15/0639; E05D 15/0613; Y10T 16/3834; E04B 2/827

See application file for complete search history.

(56) References Cited

U.S. PATENT DOCUMENTS

| | | | | |
|---|---|---|---|---|
| 2,391,431 A | | 12/1945 | Macklanburg | |
| 2,554,294 A | * | 5/1951 | Conroy | E05D 15/063 16/105 |
| 2,574,496 A | * | 11/1951 | Pomeroy | E05D 15/063 16/105 |
| 2,600,934 A | | 6/1952 | Spieth | |
| 2,617,141 A | * | 11/1952 | Sterling | E05D 15/063 16/105 |
| 2,743,127 A | | 4/1956 | Amy | |
| 2,778,068 A | * | 1/1957 | Kaufman | E06B 3/50 49/181 |
| 3,072,975 A | * | 1/1963 | Burmeister | E04B 2/827 49/317 |
| 3,193,870 A | * | 7/1965 | McNinch | E05D 15/063 16/105 |

(Continued)

OTHER PUBLICATIONS

Woodcraft, "Woodpeckers 12-Piece Plastic Knob Kit", obtained at url: http://www.woodcraft.com/product/147918/woodpeckers-12piece-plastic-knob-kit.aspx on Jan. 5, 2017, 1 page.

*Primary Examiner* — Justin B Rephann

(74) *Attorney, Agent, or Firm* — Dority & Manning, P.A.

(57) ABSTRACT

An architectural covering may include an adjustment member configured and positioned to adjust friction affecting movement of the covering. The adjustment member may be manipulated to increase friction in the architectural covering so a covering member (e.g., a panel) of the architectural covering does not move as freely as it would without the increased friction, yet the covering member nonetheless remains simple to operate. The additional friction may be effective to inhibit the covering member from moving across an associated architectural feature on its own without a user's input.

28 Claims, 6 Drawing Sheets

(56) References Cited

U.S. PATENT DOCUMENTS 3,193,871 A * 7/1965 Foltz ..... E05D 15/063 210/98
3,253,552 A * 5/1966 Stein ..... B61F 11/00 104/94
3,295,257 A * 1/1967 Douglass ..... E06B 3/481 49/317
3,329,993 A * 7/1967 Anderson ..... E05D 15/0634 16/105
3,371,372 A * 3/1968 Banse ..... E05D 15/063 16/105
3,374,821 A * 3/1968 White ..... E05D 15/063 160/40
3,378,952 A * 4/1968 Bidelman ..... E05F 5/003 49/360
3,425,162 A * 2/1969 Halpern ..... E05D 15/0634 16/105
3,479,682 A * 11/1969 McNinch ..... E05D 15/26 16/97
3,483,657 A * 12/1969 Fraioli ..... E05D 15/30 49/252
3,511,300 A * 5/1970 Matyas ..... E05D 7/0027 16/229
3,596,404 A 8/1971 Moose
3,696,560 A * 10/1972 Hallin ..... E05D 15/0634 16/105
3,750,337 A * 8/1973 Brydolf ..... E05D 15/063 16/90
3,798,839 A * 3/1974 Kaufman ..... E05D 15/0613 49/127
3,813,728 A * 6/1974 Johnson ..... E05D 15/063 16/105
3,903,647 A 9/1975 Hubbard et al.
4,043,258 A 8/1977 Zitko et al.
4,084,289 A * 4/1978 Naimo ..... E05D 15/0652 16/96 R
4,120,072 A * 10/1978 Hormann ..... E05D 15/16 16/87 R
4,277,920 A * 7/1981 Dixon ..... E04B 2/824 49/321
4,386,447 A * 6/1983 Baus ..... E05D 15/0639 16/105
4,478,006 A * 10/1984 Johnson, Jr. ..... E05D 15/0626 16/105
4,535,578 A * 8/1985 Gerken ..... E06B 7/16 49/317
4,588,117 A * 5/1986 Bott ..... B60R 9/045 224/321
4,619,095 A * 10/1986 Johnston ..... E04B 2/827 49/409
4,837,891 A * 6/1989 Toma ..... E05D 15/0613 104/111
4,964,191 A * 10/1990 Wyatt ..... E06B 9/362 16/87.2
5,042,555 A * 8/1991 Owens ..... E04B 2/827 160/116
5,209,619 A * 5/1993 Rinderer ..... F16B 37/045 411/553
5,392,561 A 2/1995 Henley, Sr.
5,414,960 A * 5/1995 O'Donnell ..... E05D 15/22 49/177
5,471,791 A * 12/1995 Keller ..... E04B 2/827 160/40
5,499,671 A * 3/1996 Owens ..... E05D 15/26 16/94 R
5,674,033 A * 10/1997 Ruegg ..... B60P 3/079 410/101
5,823,727 A * 10/1998 Lee ..... F16B 37/045 411/85
5,857,290 A * 1/1999 Schnarr ..... E05D 13/04 16/102
5,887,386 A 3/1999 Alexanian et al.
5,921,028 A 7/1999 Marocco
6,112,466 A * 9/2000 Smith ..... E06B 7/18 160/40
6,115,968 A * 9/2000 Sarlanis ..... E05D 15/0634 16/105
6,119,398 A * 9/2000 Yates, Jr. ..... E05D 13/08 49/176
6,270,301 B1 * 8/2001 Dunlop ..... B60P 7/0815 410/102
6,460,218 B2 * 10/2002 Zingg ..... E05D 15/063 16/105
6,550,184 B1 * 4/2003 O'Donnell ..... E05D 13/08 49/176
6,618,900 B2 * 9/2003 Spork ..... E05D 15/063 16/87 R
6,722,541 B1 * 4/2004 Aftanas ..... B60R 9/00 224/321
6,810,619 B2 11/2004 Wilson
7,040,849 B2 * 5/2006 Cunningham ..... B60P 7/0815 410/104
7,117,559 B1 * 10/2006 Barber ..... E05D 15/063 16/97
7,159,918 B2 * 1/2007 Lussier ..... B60P 3/40 296/26.08
7,185,398 B2 3/2007 Kral
7,214,018 B2 * 5/2007 Lussier ..... B60P 7/14 410/130
7,494,032 B2 * 2/2009 Lussier ..... B60P 3/14 224/281
7,497,651 B2 * 3/2009 Harberts ..... B60P 7/0815 410/101
7,578,096 B2 * 8/2009 Haab ..... E05F 15/638 16/87 R
7,712,258 B2 * 5/2010 Ewing ..... E05C 7/06 16/105
7,861,475 B2 * 1/2011 Sprague ..... E04B 2/827 160/196.1
7,878,743 B2 * 2/2011 Aftanas ..... B60P 7/15 410/102
8,046,872 B2 * 11/2011 Burgess, III ..... E05D 15/0639 16/103
8,359,711 B2 1/2013 Isley
8,677,564 B2 * 3/2014 Pelekanos ..... E05D 15/26 16/105
8,869,351 B2 * 10/2014 Chen ..... E05D 15/063 16/106
9,003,713 B2 4/2015 Dries
9,032,588 B2 * 5/2015 Chen ..... E06B 7/28 16/106
9,458,654 B2 * 10/2016 Palsson ..... E05D 15/0634
2002/0020507 A1 * 2/2002 Yorgason ..... E05D 15/063 160/199
2002/0048495 A1 * 4/2002 Anderson ..... B60P 7/0815 410/104
2004/0016080 A1 * 1/2004 De Oliveira ..... E05D 15/063 16/97
2009/0080995 A1 * 3/2009 Peterson ..... B60P 7/0815 410/104
2011/0126464 A1 6/2011 Stone et al.
2011/0179718 A1 * 7/2011 Martin ..... E04B 2/827 49/413
2011/0219692 A1 * 9/2011 Ohanesian ..... E06B 7/09 49/77.1
2014/0059933 A1 * 3/2014 Jones ..... E06B 7/20 49/316

* cited by examiner

FRICTION ADJUSTMENT MEMBER FOR ARCHITECTURAL COVERING

TECHNICAL FIELD

This present disclosure relates generally to architectural coverings, and more specifically to a friction adjustment member for an architectural covering.

BACKGROUND

Architectural coverings, such as coverings for architectural features, including walls, doors, and openings, such as windows, doorways, archways, and the like, have taken numerous forms for many years. Some coverings include one or more covering members that are movable across the architectural feature. For example, bifold and bipass shutters include one or more panels that slide across an architectural feature to define open and closed configurations of the architectural covering. If the one or more panels are not completely level, then the one or more panels may slide across the architectural feature on their own without a user's input, which is generally undesirable.

BRIEF SUMMARY

The present disclosure generally provides an architectural covering that offers improvements and/or an alternative to existing arrangements. The architectural covering may include an adjustment member for adjusting friction affecting movement of the covering such that friction characteristics of the architectural covering may be tailored to a specific application. The adjustment member may be manipulated to increase friction in the architectural covering so a covering member (e.g., a panel) of the architectural covering does not move as freely as it would without the increased friction, yet the covering member nonetheless remains simple to operate. The additional friction may be effective to inhibit the covering member from moving across an associated architectural feature on its own without a user's input.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The accompanying drawings, which are incorporated into and constitute a part of the specification, illustrate embodiments of the present disclosure by way of illustration only and, together with the general description above and the detailed description below, serve to explain the principles of the present disclosure.

DETAILED DESCRIPTION

Figure 1:
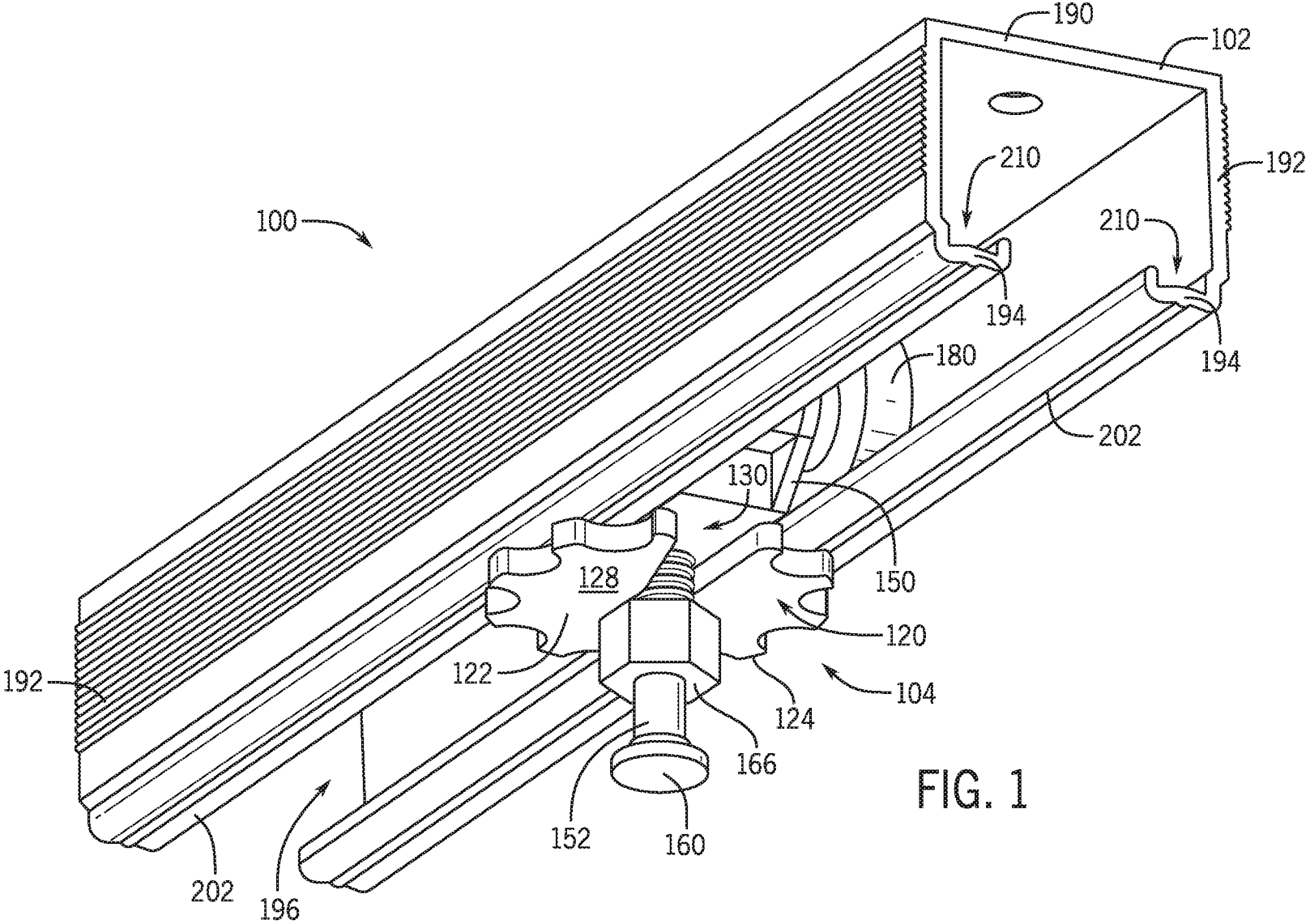
FIG. 1 is a perspective view of a carrier within a rail.

In accordance with various embodiments of the present disclosure, an architectural covering may include an adjustment member for adjusting friction affecting movement of the covering. The adjustment member may be manipulated to increase friction in the architectural covering so a covering member (e.g., a panel) of the architectural covering does not move as freely as it would without the increased friction, yet the covering member nonetheless remains simple to operate. The additional friction may be effective to inhibit the covering member from moving across an associated architectural feature on its own without a user's input.

The architectural covering may include a rail and a carrier movable along a length of the rail. The carrier may be coupled with a covering member (e.g., a panel) of the architectural covering such that the covering member is movable with the carrier along a length of the rail. Friction between the carrier and the rail may be adjustable to inhibit undesired movement of the covering member relative to the rail. In some embodiments, the carrier may include an adjustment member (e.g., a friction washer or nut) operable to adjust friction between the carrier and the rail. The adjustment member may be manipulated by a user to adjust friction between the carrier and the rail. For example, if the covering member has a tendency to move along a length of the rail without a user's input, the user may manipulate the adjustment member to increase friction between the carrier and the rail to an effective amount of friction that inhibits the carrier from moving along a length of the rail without a user's input. Alternatively, if the covering member is difficult to move along a length of the rail, the user may manipulate the adjustment member to decrease friction between the carrier and the rail to allow the user to more easily move the covering member along a length of the rail.

In one embodiment, the adjustment member is selectively engageable with the rail to adjust friction between the rail and the carrier. For example, the adjustment member may be movably coupled with the carrier. In one example, the adjustment member may be threadedly engaged with the carrier. The adjustment member may be moved towards or away from the rail to selectively engage the rail to adjust friction between the carrier and the rail. The amount of engagement between the adjustment member and the rail may set the friction between the carrier and the rail and may be controlled by a user as desired. For example, the user may increase the engagement between adjustment member and the rail to increase friction therebetween, or vice-versa. The adjustment member may include a user engagement feature (e.g., knobs, knurling, ribs, scallops, etc.) to facilitate manipulation of the adjustment member by a user.

According to an embodiment of the present disclosure illustrated in FIGS. 1-6, an architectural covering 100 includes a rail or track 102 (hereinafter "rail" for the sake of convenience without intent to limit) and a carrier, hanger plate, or hanger roller 104 (hereinafter "carrier" for the sake of convenience without intent to limit) movably coupled with the rail 102. The carrier 104 may be coupled with a covering member 106, such as a movable panel, of the covering 100 (see FIGS. 3-6) to couple the covering member 106 with the rail 102. In one example, a portion of the carrier 104 may slide in the rail 102 and another portion of the carrier 104 may be exterior to the rail 102 and may support the covering member 106. The carrier 104 facilitates movement of the covering member 106 along the length of the rail 102 so the covering member 106 may be positioned in or between a fully-open configuration and a fully-closed configuration. For instance, from a closed configuration, the covering member 106 may be moved along a length of the rail 102 via the carrier 104 to retract at least a portion of the covering member 106 across an architectural feature, such as a window, doorway, archway, or the like, thereby opening the covering 100. From an open configuration, the covering member 106 may be moved along a length of the rail 102 via the carrier 104 to extend at least a portion of the covering member 106 across the architectural feature, thereby closing the covering 100. The covering member 106 may be moved to any position between a fully-open configuration and a fully-closed configuration.

To facilitate movement of the covering member 106 along the rail 102, the carrier 104 may be coupled with the rail 102 in a manner to limit the amount of force required to move the covering member 106 across the architectural feature. In one example, an end of the carrier 104 may slide in the rail 102 and another end of the carrier 104 may be exterior to the rail 102 and may support the covering member 106 at a distance from the rail 102. The engagement between the carrier 104 and the rail 102 may be configured or structured to limit the amount of friction between the carrier 104 and the rail 102 such that the covering member 106 may be moved between its open and closed configurations with relative ease. For example, the engagement between the carrier 104 and the rail 102 may be frictionless or near frictionless. In the illustrated embodiment, the carrier 104 may include one or more rollers 180 for rolling along a surface of the rail 102. Friction between the rollers 180 and the rail 102 may be insufficient to inhibit undesired movement of the covering member 106 across the architectural feature in situations where the rail 102 is not level (e.g., horizontal). In such embodiments, the amount of friction between the carrier 104 and the rail 102 may be adjusted based on user preferences and/or installation requirements. For example, in situations where the covering member 106 has a tendency to move without a user's input (e.g., when the rail 102 is not level), a user may increase friction between the carrier 104 and the rail 102.

The adjustment member may selectively increase friction between the carrier and the rail to counteract any tendency of the covering material to move out of its desired position. Referring to FIGS. 1-6, the carrier 104 may include an adjustment member 120 positioned and operable to adjust friction between the carrier 104 and the rail 102. The adjustment member 120 may be manipulated by a user to adjust friction between the carrier 104 and the rail 102 to accommodate for various installation or post-installation conditions of the covering 100 and/or the architectural feature to which the covering 100 is associated. For example, in installation conditions where the covering member 106 tends to move towards an open or closed configuration without user input (e.g., because the rail 102 is not level), the adjustment member 120 may be manipulated by a user to increase friction between the carrier 104 and the rail 102 to limit movement of the carrier 104 relative to the rail 102 and hold the covering member 106 in any desired position, such as in the fully closed configuration, the fully open configuration, or any position between the fully closed and the fully open configurations. To increase friction between the carrier 104 and the rail 102, the adjustment member 120 may contact the rail 102 to create drag between the carrier 104 and the rail 102.

The adjustment member 120 may be operable to selectively decrease the amount of friction between the carrier 104 and the rail 102. For example, friction between the carrier 104 and the rail 102 may increase over time and/or with use, such as caused by component wear, component damage, and/or foreign material (e.g., dirt, sand, dust, food particles, or the like) being introduced between the engagement of the carrier 104 and the rail 102. In such circumstances, the adjustment member 120 may be operable to selectively decrease the amount of friction between the carrier 104 and the rail 102 to decrease the amount of force required to move the covering member 106 across the architectural feature.

Figure 2:
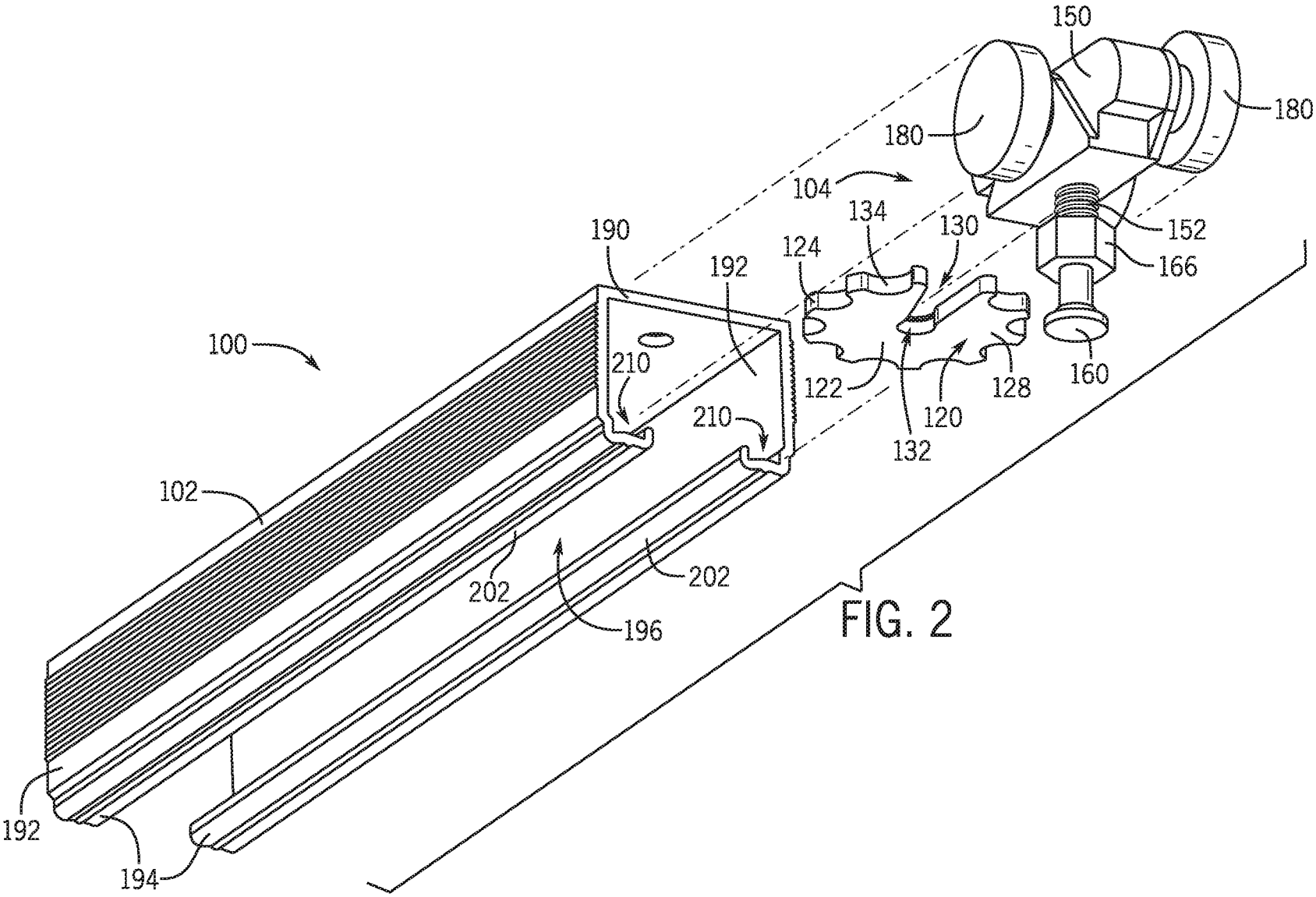
FIG. 2 is an exploded view of FIG. 1.
Figure 4:
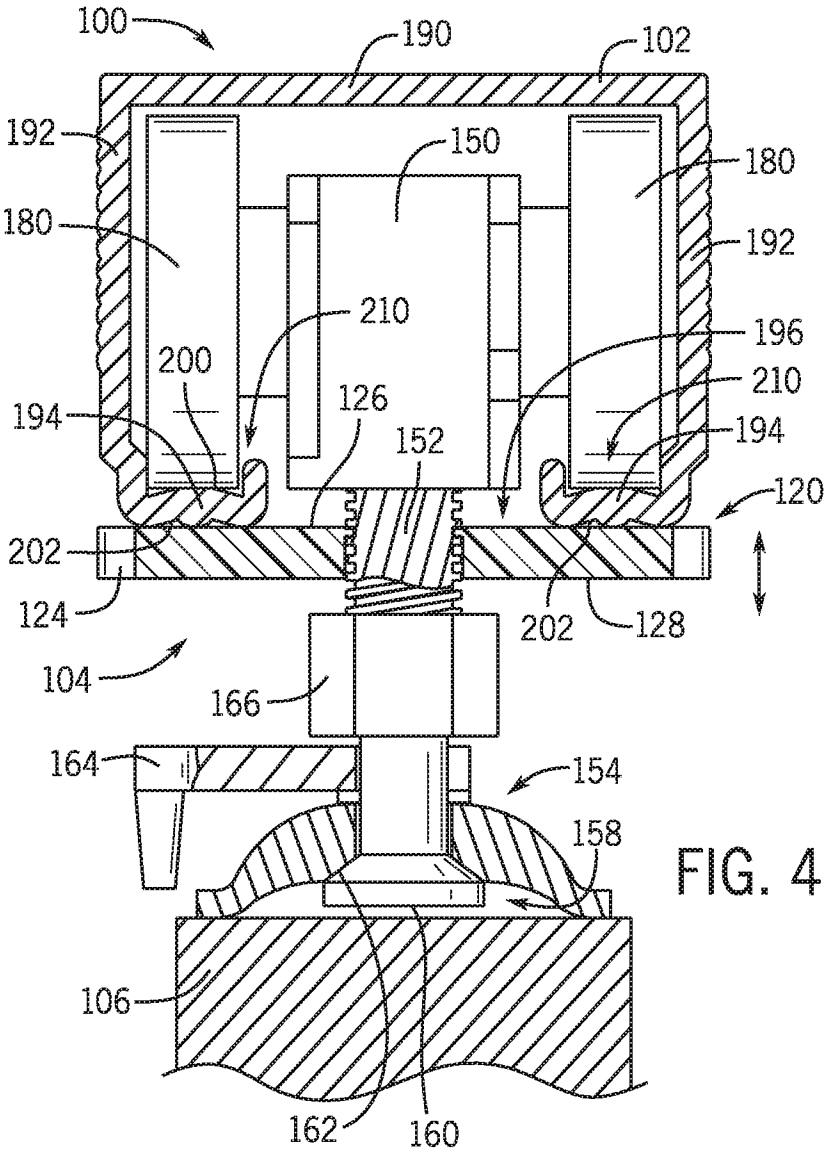
FIG. 4 is an additional end view of FIG. 1 and shows the adjustment member of FIG. 3 engaged with the rail.
Figure 3:
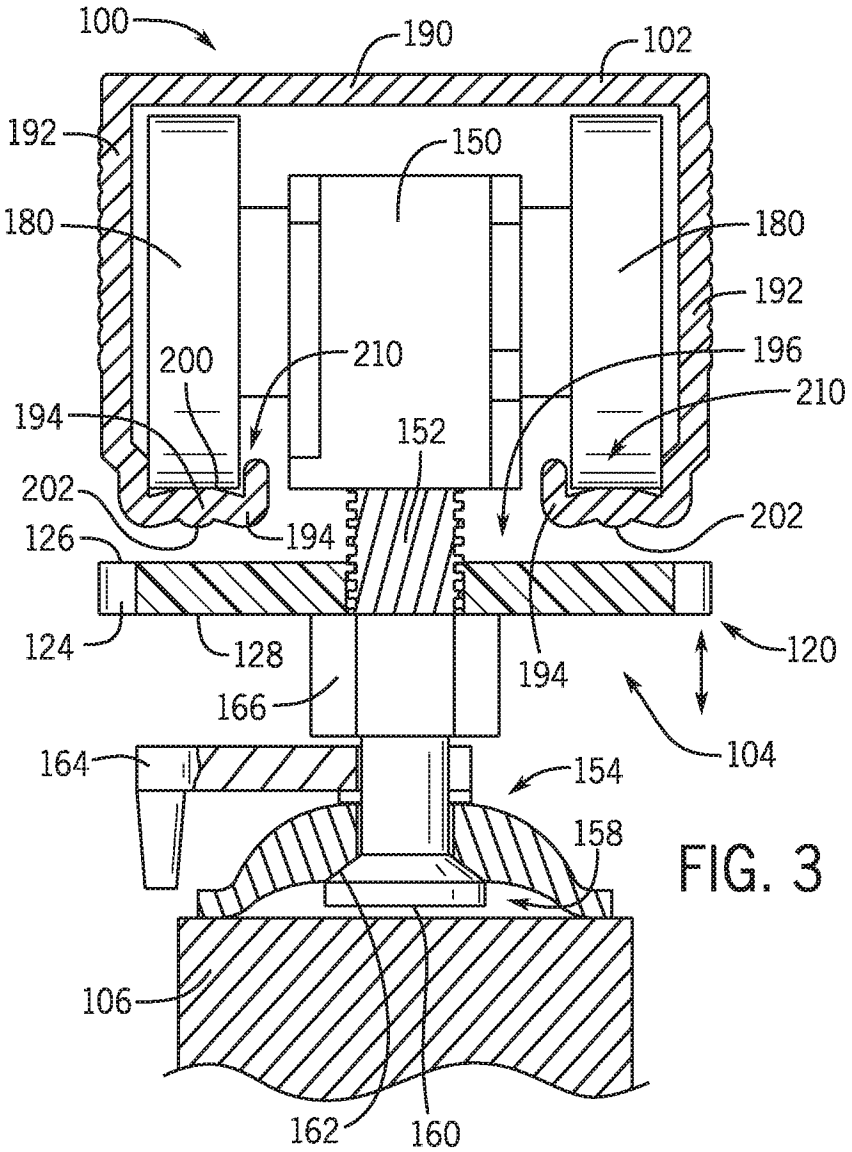
FIG. 3 is an end view of FIG. 1 and shows an adjustment member disengaged from a rail.

The adjustment member may be manipulated by a user to adjust friction between the carrier and the rail. For example, the adjustment member 120 may be adjusted by a user without disassembling the covering 100 (e.g., without disassembling the carrier 104, the covering member 106, and/or the rail 102). In other words, the adjustment member 120 may be manipulated by a user to adjust friction between the carrier 104 and the rail 102 after the covering 100 is assembled and installed. Referring to FIGS. 3 and 4, the adjustment member 120 may be positioned between the rail 102 and the covering member 106 for easy access by a user. Additionally, the adjustment member 120 may protrude laterally beyond the rail 102 to provide easy manipulation by a user. The adjustment member 120 may be configured to facilitate manipulation (e.g., tightening or loosening) by a user's hand without the need of a tool. In the embodiment illustrated in FIGS. 2-4, the adjustment member 120 may include a user engagement feature 124 for a user to engage with their hand to manipulate the adjustment member 120. The user engagement feature 124 may provide a desired tactile feel and/or grip surface for a user to engage with their hand (e.g., fingers) to facilitate the user in selectively moving the adjustment member 120 as desired, such as to increase or decrease friction between the carrier 104 and the rail 102. The user engagement feature 124 may be formed on a periphery of the adjustment member 120 and may extend outwardly (e.g., radially away) from a body 122 of the adjustment member 120 to facilitate engagement by a user. The user engagement feature 124 may be formed as knobs, knurling, ribs, scallop features, or other engagement features that facilitate manipulation of the adjustment member 120 by a user's hand. The outer shape of the adjustment member 120 may be round (as illustrated in FIGS. 1 and 2), oval, square, wavy, or other shapes that facilitate manipulation by a user. The adjustment member 120 may be relatively thin and substantially planar, as illustrated in FIGS. 3 and 4, to limit the amount of space the adjustment member 120 occupies between the rail 102 and the covering member 106.

As illustrated in the embodiment of FIGS. 1-4, a portion of the carrier 104 may be positioned within the rail 102 to couple the carrier 104 with the rail 102. For example, a portion of the carrier 104 may be received within the rail 102 and may restrict removal of the carrier 104 from the rail 102 in a transverse direction to the rail 102. Another portion of the carrier 104 may be positioned exterior the rail 102 to couple the carrier 104 with the covering member 106. For example, the covering member 106 may be fixedly coupled to the portion of the carrier 104 positioned exterior the rail 102. The adjustment member 120 may be coupled with the portion of the carrier 104 positioned exterior the rail 102 between the rail 102 and the covering member 106 to provide user access to the adjustment member 120 after the covering 100 is installed.

Referring to the embodiment illustrated in FIGS. 1-4, the carrier 104 may include a body 150 and a post or rod 152 (hereinafter "post" for the sake of convenience without intent to limit) extending away from the body 150. The body 150 may be received within the rail 102, and the post 152 may extend through a slot 196 formed in the rail 102 and may be accessible exterior to the rail 102. The adjustment member 120 may be movably coupled with the post 152 exterior to the rail 102 such that the adjustment member 120 may move towards or away from the body 150 to adjust friction between the rail 102 and the carrier 104. For example, movement of the adjustment member 120 along the post 152 towards the body 150 may increase friction between the carrier 104 and the rail 102 (see FIG. 4, for instance). Conversely, movement of the adjustment member 120 along the post 152 away from the body 150 may decrease friction between the carrier 104 and the rail 102 (see FIG. 3, for instance). When the body 150 is received inside the rail 102, movement of the adjustment member 120 towards the body 150 may cause the adjustment member 120 to engage the rail 102 to increase friction between the adjustment member 120 and the rail 102 (see FIG. 4). Continued movement of the adjustment member 120 towards the body 150 may further increase friction between the adjustment member 120 and the rail 102 by increasing the engagement between the adjustment member 120 and the rail 102. Conversely, movement of the adjustment member 120 away from the body 150 may decrease the amount of engagement between the adjustment member 120 and the rail 102, thereby decreasing friction between the adjustment member 120 and the rail 102.

The adjustment member 120 may be threadedly coupled with the post 152 to increase the mechanical advantage of the force applied to the adjustment member 120 by the user. As shown in FIGS. 2-4, the post 152 may be at least partially externally threaded, and the adjustment member 120 may be at least partially internally threaded. The thread on the post 152 may optionally be formed as a portion of a geometrical helix, which may be easier to form than other thread forms. The threaded engagement between the post 152 and the adjustment member 120 may allow the adjustment member 120 to move towards or away from the body 150 of the carrier 104 in incremental amounts determined by a user's input applied to the adjustment member 120. For instance, the adjustment member 120 may rotate about the post 152 in a first direction (e.g., clockwise) to incrementally move the adjustment member 120 towards the body 150 of the carrier 104. Conversely, the adjustment member 120 may rotate about the post 152 in a second direction (e.g., counterclockwise) to incrementally move the adjustment member 120 away from the body 150 of the carrier 104.

Figure 7:
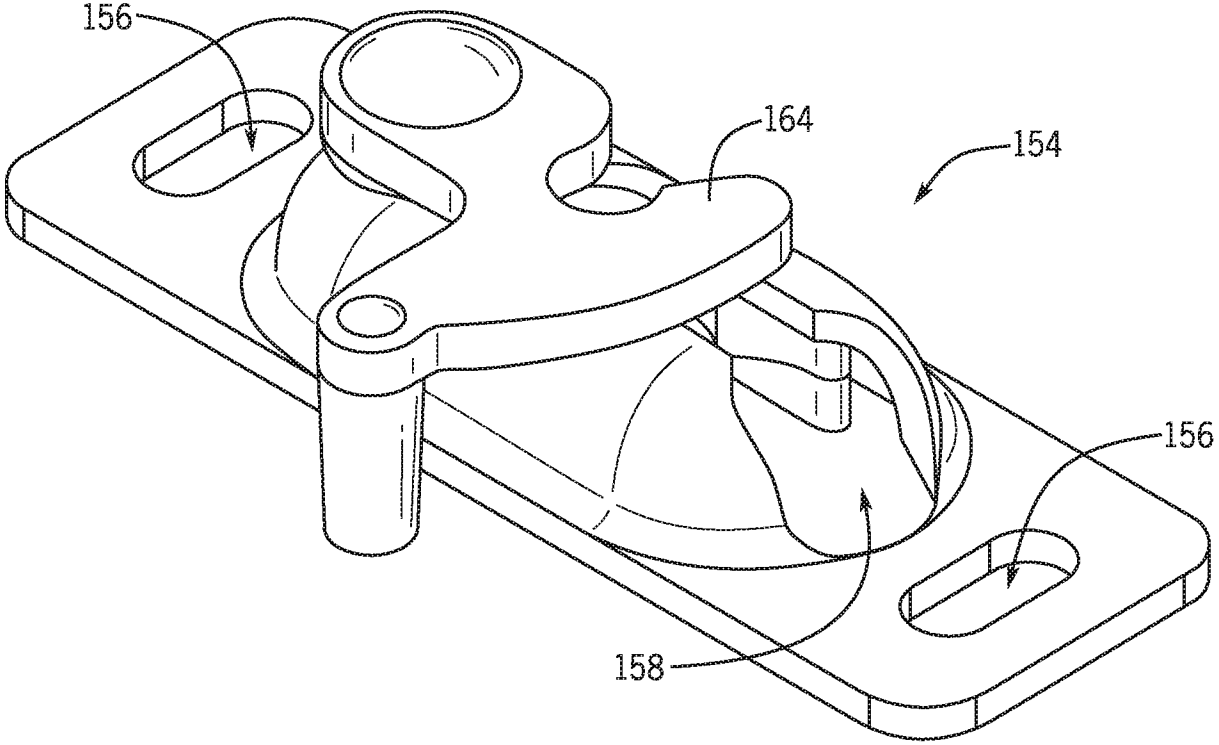
FIG. 7 is a perspective view of a clip operable to couple the carrier of FIG. 1 to a covering member.

The post 152 may be operable to couple the covering member 106 to the carrier 104. For example, as illustrated in FIGS. 3 and 4, a clip 154 may be coupled with the covering member 106, and the post 152 may be coupled with the clip 154 to couple the covering member 106 to the carrier 104. In one example, the clip 154 may be coupled with the covering member 106 via one or more fasteners, such as one or more screws, which may extend through one or more apertures 156 defined in the clip 154 (see FIG. 7) to couple the clip 154 to the covering member 106. As illustrated in FIGS. 3 and 4, the post 152 may be received in a cavity 158 defined by the clip 154 (see FIG. 7) to couple the clip 154 to the post 152. A retention structure 160 may be defined on the post 152, such as on the distal end of the post 152, and the retention structure 160 may be received in the cavity 158 to couple the covering member 106 to the post 152. As illustrated in FIGS. 1-4, the retention structure 160 may be formed as an enlarged end portion of the post 152 such that the retention structure 160 includes an outer dimension that is greater than the nominal diameter of the threaded portion of the post 152. In some embodiments, the retention structure 160 may be formed as an enlarged bolt head, a nut coupled to the post 152, and/or a flared flange, among others. To limit disengagement of the clip 154 from the post 152, the retention structure 160 may engage a portion of the clip 154, such as an internal surface 162, to limit movement of the covering member 106 away from the carrier 104. For instance, the internal surface 162 may be positioned between the retention structure 160 and the body 150 of the carrier 104 to limit movement of the covering member 106 away from the carrier 104. In some embodiments, the retention structure 160 may be inserted into the cavity 162 along a direction transverse to a longitudinal axis of the post 152 until the internal surface 162 is positioned between the retention structure 160 and the body 150 of the carrier 104 to limit movement of the covering member 106 away from the carrier 104 along a direction generally parallel to a longitudinal axis of the post 152.

To limit transverse movement of the post 152 relative to the clip 154, the clip 154 may include a latch 164 (see FIG. 7) that engages the post 152 when the retention structure 160 of the post 152 is inserted into the cavity 158 of the clip 154 to secure the post 152 in place and maintain the retention structure 160 within the cavity 162. For example, when the retention structure 160 of the post 152 is inserted into the cavity 158 of the clip 154, a portion of the latch 164 (e.g., a hook portion) may at least partially surround the post 152 to limit transverse movement of the post 152 relative to the clip 154. In one embodiment, the latch 164 may be movably, such as rotatably, coupled to the clip 154 such that a user may selectively move (e.g., rotate) at least a portion of the latch 164 towards or away from the post 152 to selectively engage or disengage the post 152, respectively. Engagement of the latch 164 with the post 152 may be determined by a user's input applied to the latch 164. For example, when the retention structure 160 of the post 152 is inserted into the cavity 158 of the clip 154, a user may move (e.g., rotate) the latch 164 towards the post 152 to at least partially surround the post 152 with the latch 164 to limit transverse movement of the post relative to the clip 154. Conversely, a user may move (e.g., rotate) the latch 164 away from the post 152 to disengage the latch 164 from the post 152 and allow transverse movement of the post 152 relative to the clip 154 to remove the post 152 from the cavity 158 and disengage the covering member 106 from the carrier 104. In some embodiments, the latch 164 may be arranged to automatically engage the post 152 when the post 152 is inserted into the cavity 158 of the clip 154. For instance, transverse movement of the post 152 within the cavity 158 and towards the latch 164 may cause the latch 164 to rotate towards the post 152 until the latch 164 at least partially surrounds the post 152, at which point further transverse movement of the post 152 relative to the clip 154 may be limited. In such embodiments, disengagement of the latch 164 from the post 152 may require positive user manipulation of the latch 164 away from the post 152. In some embodiments, the latch 164 may be biased towards the post 152 to limit inadvertent disengagement of the latch 164 from the post 152, such as via a spring or other biasing element or mechanism.

In some embodiments, whether in addition or as an alternative to the embodiments described above, the post 152 may be threaded into the covering member 106 to allow adjustment between the covering member 106 and the rail 102. In one embodiment, a nut 166 may be threaded to the post 152, such as between the retention structure 160 and the body 150 of the carrier 104. In such embodiments, the nut 166 may be tightened against the clip 154 (such as against the latch 164) and/or against the covering member 106 to further couple the carrier 104 to the covering member 106. In some embodiments, the nut 166 may be tightened against the adjustment member 120 to lock the adjustment member 120 in a desired position providing a desired amount of friction with the rail 102. Though various examples of coupling the covering member 106 to the carrier 104 via the post 152 have been shown and described, it will be appreciated that the covering member 106 may be coupled to the carrier 104 in any suitable manner, whether via the clip 154 or otherwise.

The adjustment member 120 may be coupled with the post 152 after the post 152 is coupled with the covering member 106 and the carrier 104 is inserted into the rail 102. For example, the adjustment member 120 may be removably coupled with the post 152 such that the adjustment member 120 may be coupled with or decoupled from the post 152 while the covering member 106 remains coupled with the rail 102. In the embodiment illustrated in FIGS. 1 and 2, the adjustment member 120 may be coupled to the post 152 in a direction transverse to a longitudinal axis of the post 152. As illustrated in FIG. 2, the adjustment member 120 may include a bore 132 defined through the adjustment member 120, such as in the center of the adjustment member 120. The bore 132 may threadedly receive the post 152 to permit rotation of the adjustment member 120 relative to the post 152. A cutout 130 may be defined in the adjustment member 120 for allowing the adjustment member 120 to be transversely inserted onto the post 152. The cutout 130 may extend from the bore 132 and open through an outer side edge 134 of the adjustment member 120. As illustrated in FIG. 2, the cutout 130 may taper inwardly from the outer side edge 134 towards the bore 132 defined the adjustment member 120. In one embodiment, the cutout 130 may taper to a dimension smaller than the diameter of the bore 132. During lateral insertion of the adjustment member 120 onto the post 152, the adjustment member 120 may resiliently deform to allow the post 152 to be inserted through the cutout 130 and into the bore 132 of the adjustment member 120. For example, to couple the adjustment member 120 to the post 152, the post 152 may be inserted within the cutout 130 of the adjustment member 120. The adjustment member 120 may then be moved towards the post 152 until the post 152 clicks or snaps into the bore 132. To resiliently retain the adjustment member 120 to the post 152, the adjustment member 120 may engage at least a majority of the circumference of the post 152. Additionally or alternatively, the adjustment member 120 may be threaded onto the post 152 from a terminal end of the post 152, such as from a distal end of the post 152 positioned away from the body 150, prior to coupling the post 152 to the covering member 106.

The adjustment member 120 may selectively engage the rail 102 to adjust friction between the carrier 104 and the rail 102. For instance, the adjustment member 120 may selectively engage a surface of the rail 102 to adjust a frictional force between the adjustment member 120 and the rail 102. Engagement of the adjustment member 120 with the rail 102 may apply a clamping force to a portion of the rail 102 positioned between the body 150 of the carrier 104 and the adjustment member 120 to adjust friction between the carrier 104 and the rail 102. In other words, a portion of the rail 102 may be selectively clamped between the adjustment member 120 and another portion of the carrier 104 to adjust friction therebetween, as further described below.

Referring to FIGS. 1-5, one example of how to clamp a rail between portions of a carrier is illustrated. In the embodiment illustrated in FIGS. 1-5, the carrier 104 may include one or more rollers 180 that facilitate movement of the carrier 104 along a length of the rail 102. The rollers 180 may be coupled with the body 150 of the carrier 104, such as to opposing sides of the body 150, such that the rollers 180 are rotatable relative to the body 150. The rollers 180 may rollingly engage a portion of the rail 102, such as support flanges 194, to movably support the carrier 104 within the rail 102. For example, the rollers may roll against an interior surface 200 of the support flanges 194 as the carrier 104 moves relative to the rail 102. The support flanges 194 may be positioned at least partially between the adjustment member 120 and the rollers 180. In other words, the adjustment member 120 may engage the support flanges 194 opposite the rollers 180. For example, the adjustment member 120 may engage an exterior surface 202 of the support flanges 194. Selective engagement of the adjustment member 120 with the exterior surfaces 202 of the support flanges 194 may adjust friction between the carrier 104 and the rail 102 by clamping the support flanges 194 between the rollers 180 and the adjustment member 120.

The rail 102 may limit movement of the carrier 104 only along the length of the rail 102. In other words, movement of the carrier 104 between opposing sidewalls 192 of the rail 102 may be limited. For example, as illustrated in FIGS. 1-4, the rail 102 may include a pair of channels 210 defined in the support flanges 194, and the channels 210 may extend along the length of the rail 102. The rollers 180 may be received at least partially within the channels 210 to define the movement of the carrier 104 within the rail 102. For example, the rollers may roll within the channels 210 as the carrier 104 moves along a length of the rail 102. In some embodiments, the channels 210 may be dimensioned to correspond to the size and shape of the rollers 180. For instance, the channels 210 may include a width corresponding to the width of the rollers 180.

Adjustment of friction between the carrier 104 and the rail 102 will now be discussed in more detail with reference to FIGS. 3 and 4. Referring to FIG. 3, the adjustment member 120 may be positioned away from the rail 102 to decrease friction between the rail 102 and carrier 104. For example, the adjustment member 120 may be positioned on the post 152 such that the top surface 126 of the adjustment member 120 is spaced away from the support flanges 194 of the rail 102. In such configuration, friction between the rail 102 and carrier 104 may be defined by the engagement of the rollers 180 with the rail 102, and such friction may be minimal, such as substantially frictionless. The bottom surface 128 of the adjustment member 120 may engage the covering member 106 and/or the nut 166 to define the extent of movement of the adjustment member 120 away from the rail 102.

To increase friction between the rail 102 and the carrier 104, the adjustment member 120 may be moved to engage the rail 102. For example, as shown in FIG. 4, the adjustment member 120 may be rotated about the post 152 in the first direction to move the adjustment member 120 towards the rail 102. The adjustment member 120 may be moved (e.g., rotated) towards the rail 102 until, for example, the top surface 126 of the adjustment member 120 engages the exterior surfaces 202 of the support flanges 194. Once engaged, sliding movement of the top surface 126 of the adjustment member 120 against the exterior surfaces 202 of the support flanges 194 is inhibited by friction between the top surface 126 of the adjustment member 120 and the exterior surfaces 202 of the support flanges 194. The rollers 180 may engage the interior surfaces 200 of the support flanges 194 to effectively clamp the support flanges 194 between the adjustment member 120 and the rollers 180 of the carrier 104.

The adjustment member 120 may be moved increasingly towards the rail 102 to increase friction between the rail 102 and the carrier 104. For example, the adjustment member 120 may be rotated about the post 152 in the first direction to move the adjustment member 120 increasingly towards the rail 102. In such embodiments, continued movement of the adjustment member 120 towards the rail 102 may increase friction between the rail 102 and the carrier 104, such as by providing an increasing clamping force against the support flanges 194.

At any point of operation, the adjustment member 120 may be moved to decrease friction between the rail 102 and carrier 104. For example, the adjustment member 120 may be rotated about the post 152 in the second direction to move the adjustment member 120 away from the rail 102. For example, the adjustment member 120 may be rotated in the second direction to decrease the clamping force of the carrier 104 on the support flanges 194. Additionally or alternatively, the adjustment member 120 may be rotated away from the rail 102 to disengage the top surface 126 of the adjustment member 120 from the exterior surfaces 202 of the support flanges 194.

Though shown and described as the top surface 126 of the adjustment member 120 engaging the exterior surfaces 202 of the support flanges 194, the covering 100 may be arranged such that the bottom surface 128 of the adjustment member 120 engages the exterior surfaces 202 of the support flanges 194. Additionally or alternatively, the adjustment member 120 may be arranged to engage other portions of the rail 102 to selectively adjust friction between the carrier 104 and the rail 102. For example, the adjustment member 120 may be arranged to engage the interior surfaces 200 of the support flanges 194 of the rail 102.

Figure 5:
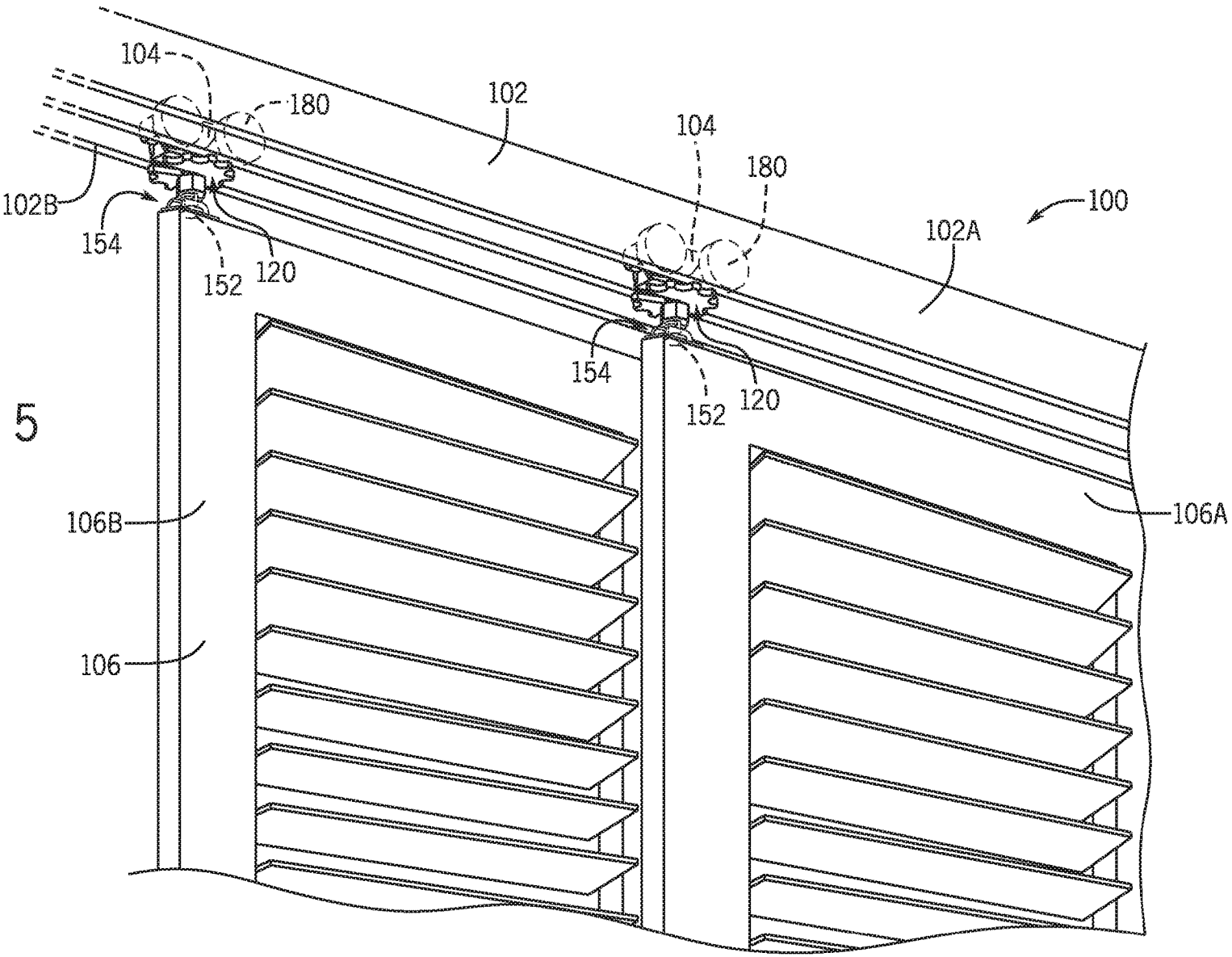
FIG. 5 is a perspective view of the carrier of FIG. 1 coupling a covering member to the rail.

In one example, the covering member 106 may be a bypass shutter panel (see FIG. 5). For example, the covering 100 may include first and second rails 102A, 102B extending adjacent to (e.g., proximately side-by-side) each other, such as in a substantially parallel manner. The second rail 102B may be positioned within the architectural feature behind the first rail 102A, or vice-versa. A first shutter panel 106A may be coupled to the first rail 102A via one or more carriers 104, and a second shutter panel 106B may be coupled to the second rail 102B via one or more carriers 104. The first shutter panel 106A may slide along the first rail 102A, and the second shutter panel 106B may slide along the second rail 102B. The first shutter panel 106A may slide along the first rail 102A independent of movement of the second shutter panel 106B along the second rail 102B, or vice-versa. For example, a user may slide the first shutter panel 106A along the first rail 102A, slide the second shutter panel 106B along the second rail 102B, or slide the first and second shutter panels 106A, 106B along the first and second rails 102A, 102B, respectively. In another example, the covering member 106 may be a bi-fold shutter (see FIG. 6). In such example, a carrier 104 may support each end of the bi-fold shutter to permit the ends of each bi-fold shutter to be moved towards or away from each other to open or close the bi-fold shutter, respectively.

Figure 6:
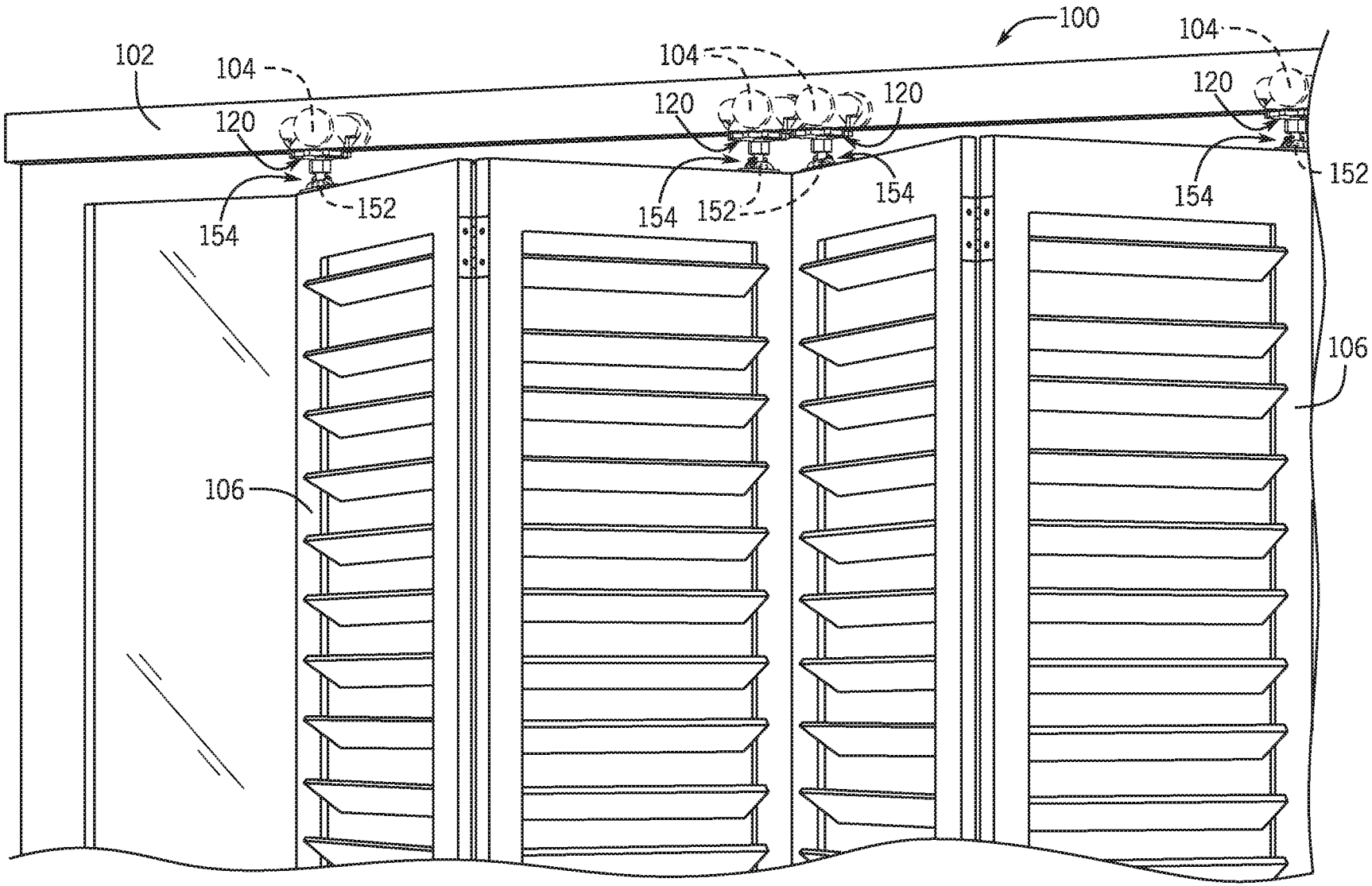
FIG. 6 is a perspective view of the carrier of FIG. 1 coupling a different covering member to the rail.

The rail 102 may be a horizontally-extending rail, though other configurations are contemplated. For example, the rail 102 may be a top rail as shown in FIGS. 5 and 6, or may be a bottom rail depending on the particular application. In some embodiments, the covering 100 may include a top rail and a bottom rail with one or more carriers 104 received within each of the top and bottom rails to support a covering member 106 extending therebetween. A wall 190 of each rail 102 may be secured to the architectural feature. In embodiments where the rail 102 is a top rail, the carrier 104 may hang from the support flanges 194 of the rail 102. In embodiments where the rail 102 is a bottom rail, the carrier 104 may roll along a wall 190 of the rail 102 disposed opposite the flanges 194.

The rail 102 may be formed as substantially any type of rail member operable to support the covering member 106. The rail 102 may be elongate and may be formed in various cross-sectional shapes. In the example illustrated in FIGS. 1-4, the rail 102 may include a substantially C-shaped cross-section. In the embodiments of FIGS. 1-4, the rail 102 includes a base wall 190 and a pair of opposing sidewalls 192 extending from the base wall 190, such as from terminal edges of the base wall 190. Support flanges 194 extend inwardly from the sidewalls 192, such as from terminal edges of the sidewalls 192. Slot 196 may be defined between the support flanges 194 through which a portion of the carrier 104 (e.g., the post 152) may move as the carrier 104 moves relative to the rail 102. The rail 102 may include other suitable profile shapes for supporting a carrier 104.

The foregoing description has broad application. It should be appreciated that the concepts disclosed herein may apply to many types of coverings, in addition to the coverings described and depicted herein. Similarly, it should be appreciated that the concepts disclosed herein may apply to many types of rails, in addition to the rail described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. An architectural covering comprising:

a rail;

a carrier movable along a length of said rail; and a covering member suspended from said carrier for movement with said carrier along the length of said rail relative to an adjacent architectural feature between an open configuration and a closed configuration;

wherein said carrier includes an adjustment member movable towards and away from said rail via rotation of said adjustment member relative to said rail to adjust friction incrementally between said carrier and said rail.

2. A covering as in claim 1, wherein said adjustment member is selectively engaged with a surface of said rail to adjust the friction between said carrier and said rail.

3. A covering as in claim 2, wherein said carrier is clampingly engaged with said rail to adjust the friction between said carrier and said rail.

4. A covering as in claim 1, wherein said carrier comprises a body movably received within said rail and a post extending from said body to an exterior of said rail.

5. A covering as in claim 4, wherein said adjustment member is threadedly coupled to a portion of said post along the exterior of said rail such that relative rotation between said adjustment member and said post results in movement of said adjustment member towards and away from said rail to adjust the friction between said carrier and said rail.

6. A covering as in claim 4, wherein said adjustment member is configured to be laterally installed onto said post with movement of said adjustment member relative to said post in a direction transverse to a longitudinal axis of said post.

7. A covering as in claim 4, wherein said post includes a threaded portion configured to engage corresponding threads of said adjustment member.

8. A covering as in claim 1, wherein said adjustment member protrudes outwardly beyond opposed sides of said rail to facilitate manipulation of said adjustment member by a user.

9. A covering as in claim 1, wherein said adjustment member includes a user engagement feature to facilitate manipulation of said adjustment member by a user's hand without use of a tool.

10. A covering as in claim 1, wherein:

said adjustment member includes a contact surface configured to contact an adjacent surface of said rail; and said adjustment member is movable towards and away from said rail in a direction perpendicular to said contact surface.

11. The covering as in claim 1, wherein said adjustment member includes a plurality of radially extending projections spaced apart from one another around an outer perimeter of said adjustment member.

12. An architectural covering comprising:

a rail;

a carrier movable along a length of said rail, said carrier comprising a body movably received within said rail and a post extending from said body along a longitudinal axis of said post to an exterior of said rail; and a covering member coupled to said carrier via said post;

wherein:

said carrier includes an adjustment member configured to be installed onto said post with movement of said adjustment member in a direction transverse to the longitudinal axis of said post; and said adjustment member is configured to adjust friction between said carrier and said rail.

13. The covering as in claim 12, wherein:

said adjustment member comprises a bore and a cutout extending from an outer perimeter of said adjustment member to said bore; and said adjustment member is configured to be installed onto said post such that said post passes through said cutout and is received within said bore as said adjustment member is installed onto said post with movement of said adjustment member in the direction transverse to the longitudinal axis of said post.

14. The covering as in claim 13, wherein said bore is configured to threadedly engage said post.

15. The covering as in claim 13, wherein a width of said cutout tapers down as said cutout extends from the outer perimeter of said adjustment member to said bore such that the width of said cutout adjacent said bore is smaller than a diameter of said post.

16. The covering as in claim 12, wherein said adjustment member is movable towards and away from said rail to adjust the friction incrementally between said carrier and said rail.

17. The covering as in claim 12, wherein rotation of said adjustment member relative to said rail results in movement of said adjustment member towards and away from said rail to adjust the friction between said carrier and said rail.

18. The covering as in claim 12, wherein movement of said adjustment member towards said body results in engagement of said adjustment member with an outer surface of said rail defined along the exterior of said rail.

19. The covering as in claim 12, wherein:

said rail includes first and second sidewalls extending along a length of said rail;

said rail defines a rail width between opposed outer faces of said first and second sidewalls in a widthwise direction of said rail;

said rail further defines a slot extending along the length of said rail, with said first and second sidewalls being spaced apart from said slot in the widthwise direction of said rail; and said adjustment member defines a width that is greater than the rail width of said rail such that portions of said adjustment member extend outwardly beyond said opposed outer faces of said first and second sidewalls in the widthwise direction of said rail.

20. The covering as in claim 12, wherein said covering member is suspended from said carrier for movement with said carrier along the length of said rail relative to an adjacent architectural feature between an open configuration and a closed configuration.

21. An architectural covering comprising:

a rail including first and second sidewalls extending along a length of said rail, said rail defining a rail width between opposed outer faces of said first and second sidewalls in a widthwise direction of said rail, said rail further defining a slot extending along the length of said rail, said first and second sidewalls being spaced apart from said slot in the widthwise direction of said rail;

a carrier movable along the length of said rail, said carrier comprising a body movably received within an interior of said rail between said first and second sidewalls; and a covering member coupled to said carrier;

wherein said carrier includes an adjustment member positioned outside said rail to adjust friction between said carrier and said rail; and said adjustment member defines a width that is greater than the rail width of said rail such that portions of said adjustment member extend outwardly beyond said opposed outer faces of said first and second sidewalls in the widthwise direction of said rail.

22. The covering as in claim 21, wherein said adjustment member is movable towards and away from said rail to adjust friction incrementally between said carrier and said rail.

23. The covering as in claim 21, wherein:

said carrier further comprises a post extending from said body of said carrier to an exterior of said rail;

said adjustment member is configured to be installed onto said post with movement of said adjustment member relative to said post in a direction transverse to a longitudinal axis of said post.

24. The covering as in claim 21, wherein said covering member is suspended from said carrier for movement with said carrier along the length of said rail relative to an adjacent architectural feature between an open configuration and a closed configuration.

25. An architectural covering comprising:

a rail;

a carrier movable along a length of said rail; and a covering member suspended from said carrier for movement with said carrier along the length of said rail relative to an adjacent architectural feature between an open position and a closed position;

wherein:

said carrier includes an adjustment member movable towards and away from said rail to adjust friction between said carrier and said rail; and said carrier is positioned and configured to provide a user with access to said adjustment member when said carrier is installed relative to said rail to allow the user to directly manipulate said adjustment member when adjusting the friction between said carrier and said rail.

26. The covering as in claim 25, wherein said adjustment member is configured to be rotated by the user relative to said rail to adjust the friction between said carrier and said rail.

27. The covering as in claim 25, wherein said adjustment member includes a plurality of radially extending projections spaced apart from one another around an outer perimeter of said adjustment member to facilitate manipulation of said adjustment member by the user.

28. The covering as in claim 27, wherein at least a portion of said plurality of radially extending projections protrude outwardly beyond opposed sides of said rail.

* * * * *